US005884513A

United States Patent [19]

Norris

[11] Patent Number: 5,884,513

[45] Date of Patent: Mar. 23, 1999

[54] COMBINATION COIN AND KEY HOLDER

[76] Inventor: Donald E. Norris, 1 Riedcrest Pl., Kansas City, Kans. 66101

[21] Appl. No.: 947,431

[22] Filed: Oct. 9, 1997

[51] Int. Cl.[6] ..... A44B 15/00

[52] U.S. Cl. ..... 70/456 R; 206/38; 206/81; D3/211; D3/208

[58] Field of Search ..... 70/456 R; D3/207, D3/208, 209, 210, 211, 212; 206/37.1, 37.4, 38, 38.1, 0.84, 0.81

[56] References Cited

U.S. PATENT DOCUMENTS

| | | | |
|---|---|---|---|
| D. 126,374 | 4/1941 | Calichio | D3/211 |
| D. 172,023 | 4/1954 | Henry | D3/208 |
| D. 311,451 | 10/1990 | Chan | D3/211 |
| D. 326,040 | 5/1992 | Wysopal | D3/211 |
| D. 349,399 | 8/1994 | Di Paolo et al. | D3/208 |
| 2,537,598 | 1/1951 | Mason . | |
| 2,569,629 | 10/1951 | Everitt . | |
| 2,596,374 | 5/1952 | Crapster . | |
| 2,694,844 | 11/1954 | Grumbach, II et al. | 70/456 R |
| 3,016,940 | 1/1962 | Mullin . | |
| 3,473,648 | 10/1969 | Paluzzi . | |
| 3,918,503 | 11/1975 | Bundy . | |
| 3,945,491 | 3/1976 | Lindewbaum | 206/0.81 |
| 4,166,489 | 9/1979 | Lemelson . | |
| 4,907,694 | 3/1990 | Miller et al. . | |

*Primary Examiner*—Darnell M. Boucher
*Attorney, Agent, or Firm*—Litman, McMahon & Brown, L.L.C.

[57] ABSTRACT

A combination coin and key holder includes a coin holder housing which has an outline shaped as a vehicle. A closed loop is attached to the coin holder housing, preferably in the front end of the vehicle outline, for connection of a key ring, chain, or other key holding device thereto. A pair of coin slots are provided in the coin holder housing on the bottom side of the vehicle outline, with each slot being dimensioned to hold a specific coin. The coin slots are positioned and configured such that coins inserted thereon are reliably, yet removably retained in place, but such that they protrude sufficiently to have the appearance of a wheel or wheels on the vehicle outline.

12 Claims, 1 Drawing Sheet

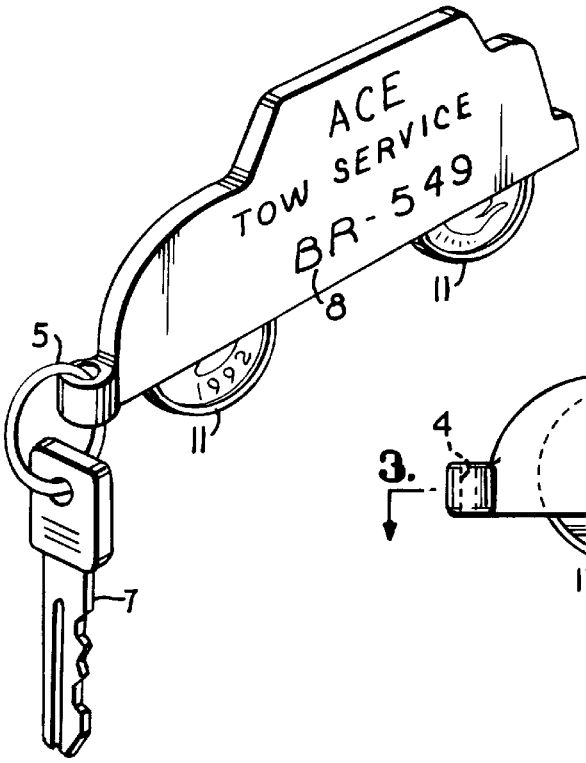
Fig.1.
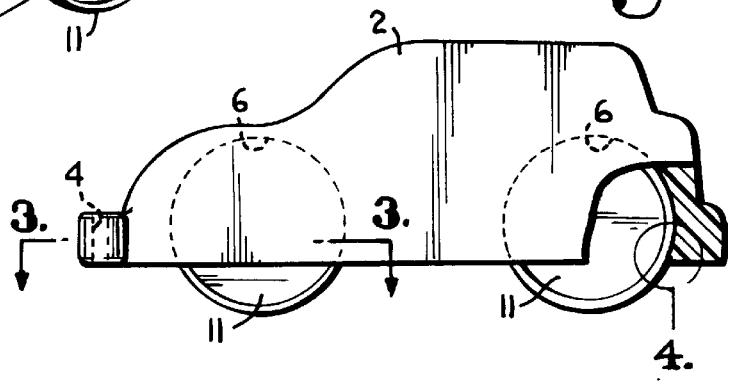
Fig.2.
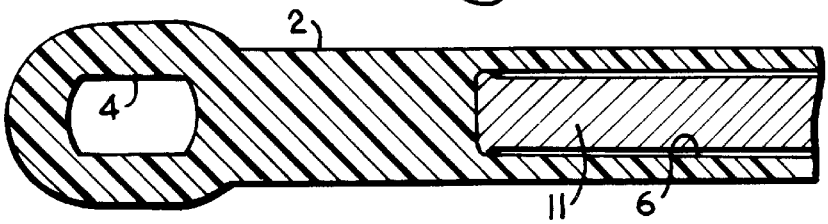
Fig.3.
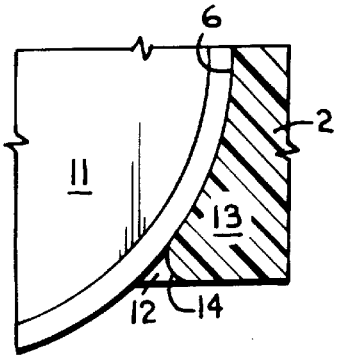
Fig.4.
Fig.5.
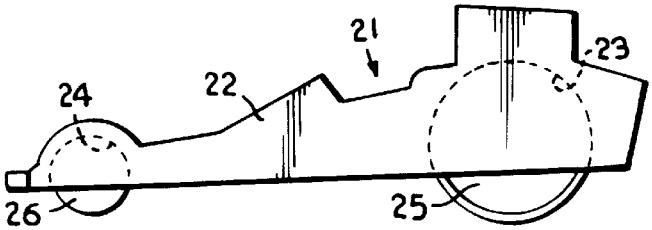

COMBINATION COIN AND KEY HOLDER

BACKGROUND OF THE INVENTION

1. Field of the Invention

This invention relates to a combination coin and key holder, and more specifically to a such a coin and key holder with a housing shaped as a vehicle with the housing including coin slots which removably hold coins in positions in which they present the appearance of wheels of the vehicle.

2. Description of the Prior Art

Vehicle operators occasionally need quick access to coins for pay phones, toll booths, or other travel related necessities. There have been prior attempts to associate coins with key holding devices such that the coins are available to a vehicle operator.

For example, U.S. Pat. No. 3,473,648 to Paluzzi discloses a car-key/coin holder with a coin holding sleeve with an end opening closed off via a spring loaded key holder. In order to remove the coins from the sleeve, the spring clip must first be removed by pressure exerted through top and/or bottom openings in the sleeve. The coins are thus not readily accessible without disassembly of the key holder.

U.S. Pat. No. 4,166,503 to Bundy, U.S. Pat. No. 4,166,489 to Lemelson and U.S. Pat. No. 4,907,694 to Miller et al. are all directed to combination coin and key holders, each of which holds coins in a pouch or sleeve such that the coins are not visible and such that the pouch or sleeve must be opened to allow access to the coins.

It is clear, then, that a combination coin and key holder is needed which holds both keys and coins in such a manner that the coins are visible and quickly and readily accessible. It would also be desirable if the coins form a visible part of the design of the holder such that it is readily apparent when coins are missing, thus giving a user a reminder and incentive to keep it loaded with coins.

SUMMARY OF THE INVENTION

The present invention is a combination coin and key holder which holds both keys and coins in a manner such that the coins are visible, readily accessible, and contribute to the appearance of the holder. The coin and key holder includes a coin holder with a housing which has an outline shaped as a vehicle. A closed loop is attached to or forms a portion of the housing, preferably in the front end of the vehicle outline, for connection of a key ring, chain, or other key holding device thereto. One or more slots are provided in the coin holder housing, preferably on the bottom side of the vehicle outline, with each slot being dimensioned to hold a specific coin. The slot(s) are positioned and configured such that coins inserted thereon are reliably, yet removably retained in place, but such that they protrude sufficiently to give the appearance of a wheel or wheels on the vehicle outline.

OBJECTS AND ADVANTAGES OF THE INVENTION

Objects and advantages of the invention include: to provide a combination coin and key holder; to provide such a coin and key holder which holds coins in a manner such that they are visible and readily accessible; to provide such a coin and key holder in which a coin holder has a housing with an outline shaped as a vehicle; to provide such a coin and key holder in which the coin holder housing includes a slot or slots dimensioned and positioned to hold one or more coins; to provide such a coin and key holder in which the coins, when positioned in the slots, resemble wheels on the vehicle outline; to provide such a coin and key holder in which any missing coins are immediately apparent to a user to give the user a reminder and an incentive to keep coins loaded into the coin holder; and to provide such a coin and key holder which is particularly well adapted to its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a combination coin and key holder in accordance with the present invention.

FIG. 2 is a side elevational view of the coin and key holder of FIG. 1, with a portion of a coin holder housing broken away to illustrate a coin holding slot.

FIG. 3 is an enlarged, fragmentary cross-sectional view of the coin and key holder, taken along line 3—3 of FIG. 2, and illustrating a coin holding slot and a key holding loop.

FIG. 4 is a greatly enlarged view of the portion of the coin and key holder, as indicated by the circled area 4, of FIG. 2.

FIG. 5 is a side elevational view of an alternative embodiment of coin and key holder in which the coin holder is equipped with differently sized slots for different coin denominations.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring now to the drawing FIGS. 1–4, a first embodiment of a combination coin and key holder is shown and generally indicated at 1. The coin and key holder 1 includes a coin holder housing 2 which has a vehicle shaped outline, a loop 3 with a centered vertical opening 4 attached to the front of the coin holder housing 2 and a key ring 5 which is inserted through the opening 4 in the loop 3. The coin holder 3 includes a pair of coin holding slots 6, each of which is uniform in size in the embodiment of FIGS. 1–4. Each coin slot 6 in the embodiment of FIGS. 1–4 is sized to receive a quarter coin 11 such that approximately the bottom third of each of the quarters 11 protrude outward and downward from the respective slot 6. The quarters 11 thus give the appearance of wheels when the vehicle outline of the coin holder housing 2 is viewed from the side. A key 7 is illustrated as attached to the key ring 5, which key 7 can be, e.g., an automobile ignition key. The key ring 5 can comprise a conventional expanding coil spring metal key ring, a flexible leather or nylon loop, a rigid plastic loop and clasp, etc., and "key ring" as used herein and in the claims is meant to encompass these and other types of key holding loops.

The combination coin and key holder 1 is an ideal advertising and promotional item and can include customized advertising indica 8 printed on one or both sides of the coin holder housing 2. For example, the coin holder housing 2 can be molded in the shape of a particular automobile style sold by an automobile dealer, imprinted with the dealer's phone number and address, and given to a customer of the dealer with the ignition keys.

The coin holder housing 2 is preferably constructed of a durable, yet flexible and resilient plastic, such as polypropylene or other suitable injection moldable polymer. The material is molded into an integral vehicle shape with the coin slots 6 molded therein. The loop 3 with the centered vertical opening 4 can be integrally molded into the coin holder housing 2, or, alternatively, can constitute a separate loop formed of a more rigid material which is riveted or otherwise affixed to the coin holder housing 2. The material chosen for the coin holder housing 2 must be of such consistency as to allow the coins 11 to be inserted into and extracted from the slots 6 by flexing of the material. At the same time, the coin holder material must be resilient and rigid enough that the slots 6 will retain the coins 11 until deliberately extracted.

FIGS. 2–4 illustrate in greater detail the placement and shape of the coin holding slots 6 which are each in the shape of a truncated circle slightly larger in diameter than the denomination of coins 11 which it is designed to receive, with an open bottom 12. Sides 13 of the open bottom of each slot 6 thus extend inward to form detents 14. Due to the flexible and resilient nature of the material forming the coin holder housing 2, once a coin 11 is inserted into a respective slot 6, it is retained there by the detents 14 until the slot 6 is again flexed by pulling and twisting on the coin 11.

FIG. 5 is an alternate embodiment of the combination coin and key holder, generally indicated at 21. The coin and key holder 21 includes a coin holder housing 22, which can be formed of the same material and in the same manner as the coin holder housing 2 described above. The coin holder housing 22 includes a pair of coin holding slots 23 and 24 which are sized differently to receive and retain different coin denominations, such as a quarter 25 in the rear slot 23 and a dime 26 in the front slot 24.

Many variations on the illustrated embodiments of the invention are possible without departing from the scope of the claims. For example, the coin holders 2 or 22 can be made considerably wider and can contain four or more coin slots 6, or multiple pairs of coin slots 23 and 24, respectively, to receive four or more total coins. Considerable variety in the shape of the coin holder housings 2 and 22 can be envisioned, and, although illustrated as automobile shapes, they can take the form of any wheeled vehicle including, without limitation, tractors, trucks, trailers, RV's, ATV's, wagons, carts, etc. Although the invention has been shown and described as a combination coin and key holder, it is envisioned that a stand alone coin holder can be made with a similar shape and function which does not include an attached key ring.

It is thus to be understood that while certain forms of the present invention have been illustrated and described herein, it is not to be limited to the specific forms or arrangement of parts described and shown.

What is claimed and desired to be secured by Letters Patent is as follows:

1. A combination coin and key holder, comprising:

a. a coin holder housing made of a flexible and resilient material and shaped with an outline resembling a vehicle, said housing including a pair of slots formed therein with each of the slots being sized and positioned to receive and retain a coin with a portion of the retained coin protruding outward from the coin holder housing, said slots being positioned within said housing such that a pair of coins held in said slots resemble wheels of the vehicle; and b. a key ring attached to said coin holder housing.

2. A combination coin and key holder as in claim 1, wherein each said slot is formed as a truncated circle with a truncated end of the circle being open and forming opposing detents.

3. A combination coin and key holder as in claim 2, wherein said coin holder housing material is a molded polymer which is resilient enough to allow individual coins to be forced into respective ones of the slots past said detents yet rigid enough to retain said coins until deliberately extracted.

4. A combination coin and key holder as in claim 1, and further comprising a loop attached to said coin holder housing in a position such that said key ring can be inserted through said loop.

5. A combination coin and key holder as in claim 1, and further comprising indicia printed on said coin holder housing.

6. A combination coin and key holder, comprising:

(a) coin holder housing made of a flexible and resilient material with an outline formed in the general shape of a vehicle, said coin holder housing including at least a pair of coin slots formed therein with each slot being formed as a truncated circle with a truncated end of the circle being open and forming opposing detents, each of the truncated circles being sized and positioned to retain a respective coin with a portion of the retained coin protruding outward from the coin holder housing in a position such that the coins appear to constitute wheels of the vehicle and with each coin being removably held in place by said detents; and (b) a key ring attached to said coin holder housing.

7. A combination coin and key holder as in claim 6, wherein said coin holder housing material is a molded polymer which is resilient enough to allow individual coins to be forced into respective ones of the slots past said detents yet rigid enough to retain said coins until deliberately extracted.

8. A combination coin and key holder as in claim 6, and further comprising a loop attached to said coin holder housing in a position such that said key ring can be inserted through said loop.

9. A combination coin and key holder as in claim 6, and further comprising indicia printed on said coin holder housing.

10. A coin holder comprising a housing made of a flexible and resilient molded material with an outline formed in the general shape of a vehicle, said housing including at least a pair of coin slots formed therein with each of the slots being formed as a truncated circle with a truncated end of the circle being open and forming opposing detents, each of the truncated circles being sized and positioned to receive and retain a respective coin with a portion of each retained coin protruding outward from the coin holder housing with the coins being in positions such that they constitute wheels of the vehicle and with each coin being removably held in place by said detents.

11. A combination coin and key holder as in claim 10, wherein said material is a molded polymer which is resilient enough to allow individual coins to be forced into respective ones of the slots past said detents yet rigid enough to retain said coins until deliberately extracted.

12. A combination coin and key holder as in claim 9, and further comprising indicia printed on said coin holder housing.

* * * * *